US006880608B2

(12) United States Patent
Robinson

(10) Patent No.: US 6,880,608 B2
(45) Date of Patent: Apr. 19, 2005

(54) LADDER FOR HORIZONTAL BLINDS

(76) Inventor: Craig A. Robinson, 8039 N. 10th Ave., Phoenix, AZ (US) 85021

( * ) Notice: Subject to any disclaimer, the term of this patent is extended or adjusted under 35 U.S.C. 154(b) by 0 days.

(21) Appl. No.: 10/372,595

(22) Filed: Feb. 24, 2003

(65) Prior Publication Data

US 2003/0173038 A1 Sep. 18, 2003

Related U.S. Application Data

(60) Provisional application No. 60/359,529, filed on Feb. 22, 2002.

(51) Int. Cl.[7] ..... E06B 9/382
(52) U.S. Cl. ..... 160/178.3
(58) Field of Search ..... 160/178.3, 173 R, 160/178.1 R; 29/24.5

(56) References Cited

U.S. PATENT DOCUMENTS 2,489,467 A * 11/1949 Sherwood ..... 29/24.5

* cited by examiner

*Primary Examiner*—Blair M. Johnson
(74) *Attorney, Agent, or Firm*—Knobbe, Martens, Olson & Bear, LLP

(57) ABSTRACT

A ladder for horizontal blinds is provided having a drawstring pre-threaded through a plurality of loops on at least a first leg. A second drawstring pre-threaded through a plurality of loops on a second leg may also be provided. When assembling horizontal blinds using the ladder, a pull cord is easily threaded through the loops by securing it to the drawstring and pulling the drawstring/pull cord junction through each of the loops. Manufacturing costs associated with assembling horizontal blinds are thus reduced by eliminating the labor-intensive step of individually hand threading a pull cord through each loop.

12 Claims, 3 Drawing Sheets

LADDER FOR HORIZONTAL BLINDS

RELATED APPLICATIONS

This application claims priority to provisional Application No. 60/359,529 filed Feb. 22, 2002, the entirety of which is hereby incorporated by reference.

BACKGROUND OF THE INVENTION

1. Field of the Invention

The present invention provides a ladder for horizontal blinds. More particularly, preferred embodiments of the ladder provide a drawstring that is pre-threaded through external loops on the ladder.

2. Description of the Related Art

Horizontal blinds typically comprise rows of horizontal slats that hang in front of a window. An exemplary set of horizontal blinds 10 is depicted in FIG. 2. The slats 12 are typically supported from a headrail 14 by ladders 16. A set of blinds generally includes at least two spaced ladders, and often up to four or five spaced ladders, depending upon the length of the slats. The ladders 16 are connected to a tilting mechanism within the headrail 14, which is often manipulable through a rotatable vertical rod 18 or a loop chain. Adjusting the angle of tilt of the slats regulates the amount of exterior light that penetrates to the interior of the building through the window. An interior of the headrail may contain tape drums, rollers, lift cord actuators and locks, tilting mechanisms, tilt rods, etc. for tilting and raising/lowering the slats.

The ladders 16 (shown in detail in FIG. 3) typically include a pair of vertical legs 20 supporting a plurality of spaced horizontal rungs 22. Each rung may comprise a pair of cords so that the slats may be inserted between the cords, facilitating rotation of the slats. Each leg 20 is connected at a bottom end to a bottom rail, which is typically thicker and heavier than the slats. From the bottom rail, each leg runs vertically upward to the headrail 14. The upper extent of each leg is usually connected to a tilting mechanism in the headrail. The tilting mechanism shortens one leg while releasing some slack in the other leg to rotate the slats about a longitudinal axis of each slat. The orientation of each slat about its longitudinal axis controls the amount of light that penetrates the blinds.

Most ladders include one or more pull cords 24 (FIG. 3). Each pull cord 24 is secured at a bottom end to the bottom rail, and rises vertically to the headrail 14. An upper end of each pull cord 24 passes into the headrail, around a pulley, horizontally toward one end of the headrail, around a second pulley, and out through an opening in the bottom of the headrail (FIG. 2). A free end of each pull cord is usually joined together with the free ends of the other pull cords in a knot. This knot is typically enclosed by a decorative cover 26. Pulling downward on the free ends of the pull cords raises the bottom rail by drawing the pull cords around the pulleys in the headrail. As the bottom rail rises, it contacts the lowermost slat, which in turn contacts the next lowermost slat, etc. The pull cords and the bottom rail thus control the raising and lowering of the blinds.

In one common configuration, the pull cord comprises a third leg positioned between the two outside legs. This third leg usually passes through a hole in each slat. In this configuration, the outside legs serve merely to retain the slats, preventing them from exiting the ladders in a lateral direction. The central leg both prevents the slats from sliding out of the ladders in a lengthwise direction, and raises and lowers the blinds.

In another common configuration, shown in FIGS. 2 and 3, one or both legs includes a plurality of evenly spaced loops 28 (FIG. 3) on an outward facing side. One or two pull cords 24 (depending upon whether one or both legs includes loops) pass through the loops 28. In this configuration, the legs again prevent the slats from exiting the ladders in a lateral direction. Typically the slats include notches 30 along their edges corresponding to the positions of the legs 20. The mating fit between the legs 20 and notches 30 prevents the slats from sliding lengthwise out of the ladders 16. The pull cords facilitate raising and lowering of the blinds.

Typically, horizontal blinds are assembled in one location using various components, for example, slats, ladders and headrails, that are each manufactured in separate locations. When assembling horizontal blinds using ladders having loops, the pull cord(s) must be threaded through the loops during assembly. In prior art assemblies, this threading has been a very labor-intensive process, requiring a factory worker to thread the pull cord through each loop by hand. This process is tedious and takes a great deal of time. Because of the time required, the labor costs associated with producing these blinds are high. The high labor costs result in a more expensive end product.

Thus, a ladder for horizontal blinds that simplifies the assembly process would reduce the retail price of horizontal blinds, making them more affordable for consumers.

SUMMARY OF THE INVENTION

The preferred embodiments of the ladder for horizontal blinds have several features, no single one of which is solely responsible for their desirable attributes. Without limiting the scope of this ladder as expressed by the claims that follow, its more prominent features will now be discussed briefly. After considering this discussion, and particularly after reading the section entitled "Detailed Description of the Preferred Embodiments," one will understand how the features of the preferred embodiments provide advantages, which include simplified assembly, reduced production costs and lower retail price for horizontal blinds including the ladder.

In a preferred embodiment, the ladder for horizontal blinds comprises a first leg, a second leg, and a plurality of rungs connected between the legs. A plurality of loops are connected to the first leg and a drawstring is threaded through substantially all of the loops on the first leg.

In another preferred embodiment, the ladder for horizontal blinds comprises a first leg, a second leg, and a plurality of rungs connected between the legs. A plurality of loops are connected to the first leg and a second plurality of loops are connected to the second leg. A first drawstring is threaded through substantially all of the loops on the first leg, and a second drawstring is threaded through substantially all of the loops on the second leg.

In another preferred embodiment, a method of assembling horizontal blinds comprises the step of providing a ladder having a first leg and a second leg, a plurality of rungs attached between the legs, a plurality of loops attached to the first leg, and a drawstring pre-threaded through the loops. In a further preferred embodiment, the method further comprises the step of securing an upper end of the drawstring to a lower end of a pull cord. And in a further preferred embodiment, the method further comprises the step of drawing the pull cord through each loop by pulling the upper end of the drawstring successively through each loop.

In another preferred embodiment, a method of assembling horizontal blinds comprises the step of providing a ladder having a first leg and a second leg, a plurality of rungs attached between the legs, a plurality of loops attached to the first leg, a plurality of loops attached to the second leg, a first drawstring pre-threaded through the loops on the first leg, and a second drawstring pre-threaded through the loops on the second leg. In a further preferred embodiment, the method further comprises the step of securing an upper end of the first drawstring to a lower end of a first pull cord. In a further preferred embodiment, the method further comprises the step of drawing the first pull cord through each loop on the first leg by pulling the upper end of the first drawstring successively through each loop. In a further preferred embodiment, the method further comprises the step of securing an upper end of the second drawstring to a lower end of a second pull cord. And in a further preferred embodiment, the method further comprises the step of drawing the second pull cord through each loop on the second leg by pulling the upper end of the second drawstring successively through each loop.

BRIEF DESCRIPTION OF THE DRAWINGS

The preferred embodiments of the ladder for horizontal blinds, illustrating its features, will now be discussed in detail. These embodiments depict the novel and non-obvious ladder shown in the accompanying drawings, which are for illustrative purposes only. These drawings include the following figures, in which like numerals indicate like parts.

DETAILED DESCRIPTION OF THE PREFERRED EMBODIMENTS

Figure 1:
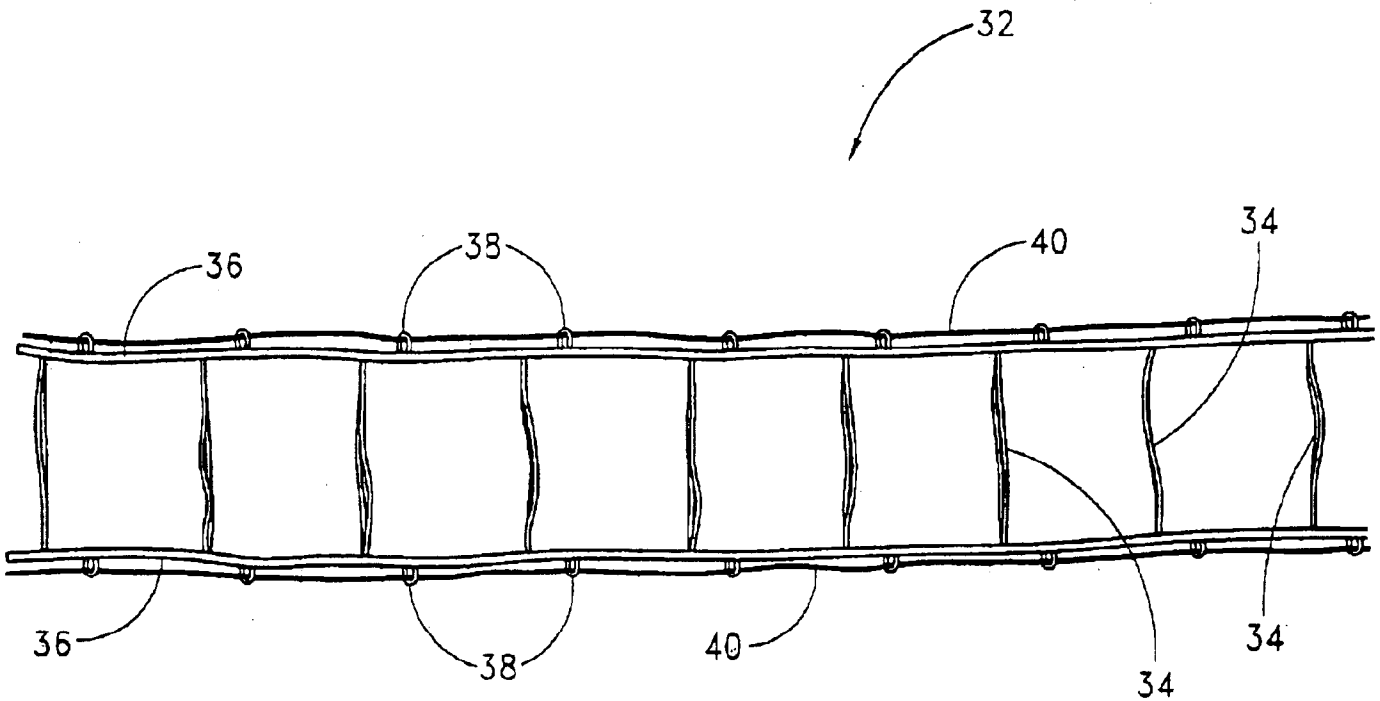
FIG. 1 is a front view of a preferred embodiment of the ladder for horizontal blinds.

As FIG. 1 illustrates, a preferred embodiment of the ladder 32 for horizontal blinds includes a plurality of rungs 34, each connected at first and second ends to first and second legs 36. In the illustrated embodiment, each rung 34 comprises first and second cords. However, those of skill in the art will appreciate that each rung 34 could include only one cord. Preferably the ladder 32 is constructed of a flexible, durable, fray-resistant fiber, such as nylon or polyester.

Figure 2:
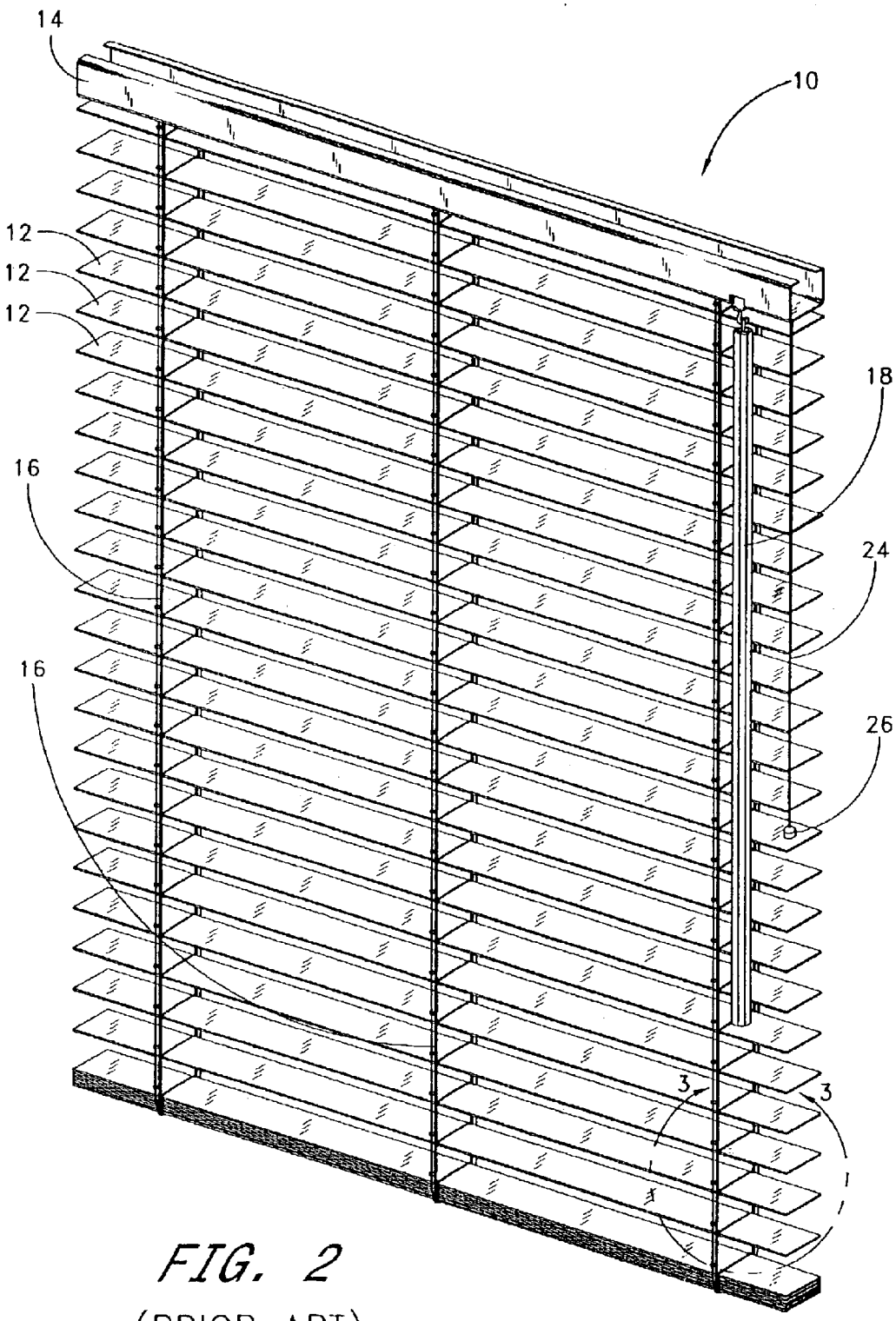
FIG. 2 (PRIOR ART)
FIG. 2 is a perspective view of a prior art horizontal blind assembly.
Figure 3:
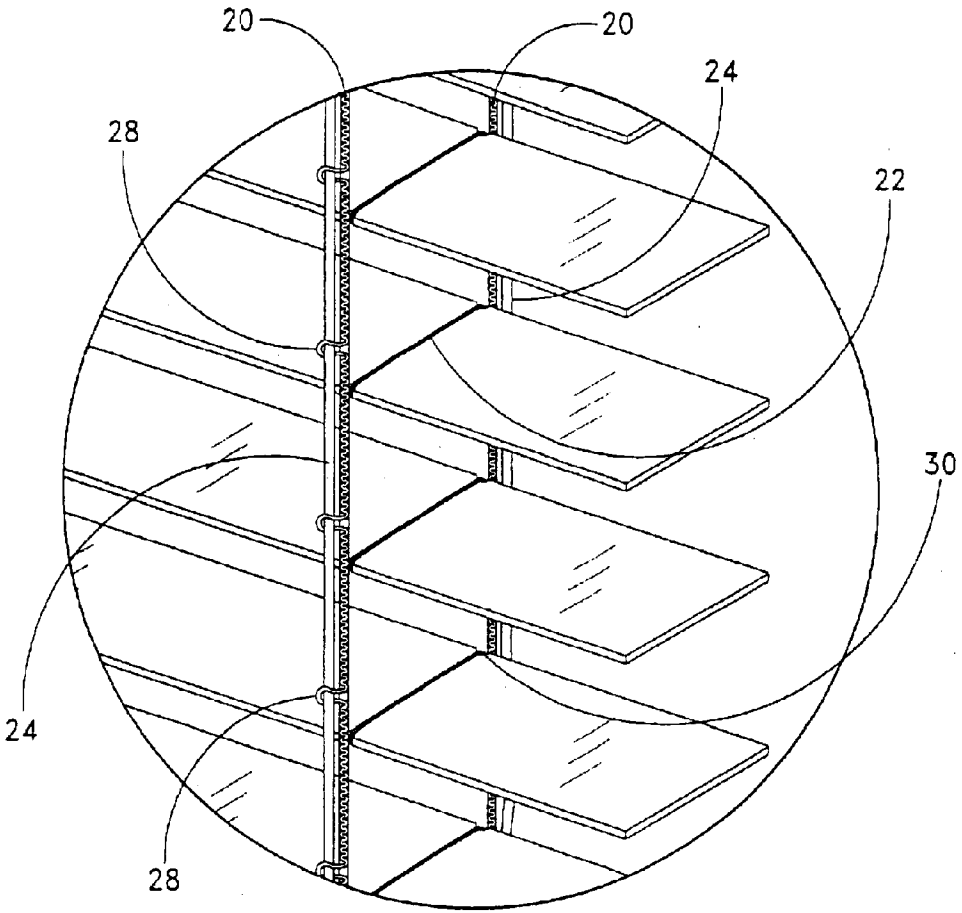
FIG. 3 (PRIOR ART)
FIG. 3 is a detail view illustrating the ladder of the horizontal blind assembly of FIG. 2.

An outward facing side of each leg 36 includes a plurality of loops 38. In the illustrated embodiment, the loops 38 are preferably evenly spaced, and spaced approximately equally as the rungs 34. Those of skill in the art will appreciate, however, that the loops 38 could be unevenly spaced, or spaced more narrowly or more widely than the configuration shown. Further, although the illustrated embodiment includes loops 38 on each leg 36, those of skill in the art will appreciate that the ladder 32 could have loops 38 on only one leg. The circumference of each loop is preferably large enough to accommodate a pull cord, such as the pull cord 24 of FIG. 3, yet small enough to be relatively unnoticeable in a horizontal blind assembly, such as the assembly 10 of FIG. 2.

A drawstring 40, preferably comprising a relatively thin length of fiber, is threaded through each of the loops 38 (FIG. 1). The drawstring 40 facilitates assembly of horizontal blinds, as described below. The drawstring 40 is preferably able to withstand a pre-determined tensile load without breaking.

Generally, the component parts of a typical horizontal blind assembly are manufactured in separate facilities. The headrail is produced in one facility, while the ladder is produced in a different facility, and the slats are produced in yet another facility. The completed component parts are then shipped to an assembly facility where they are put together.

To assemble a set of horizontal blinds using the ladder 10, typically all pull cords 24 are first threaded through the headrail 14. This step could, however, be performed at virtually any point in the assembly process. A lower extent of each pull cord 24 is then threaded, one-by-one, through the loops 38 on each ladder 32. To perform the threading, a lower end of each pull cord 24 is tied or otherwise secured to an upper end of a drawstring 40. The drawstring 40 has already been threaded through each loop 38 on one leg 36 of one ladder 32 during the manufacturing process for the ladder 32. Pulling on a lower end of the drawstring 40 causes the upper end of the drawstring 40 to successively exit each loop 38. As the drawstring 40 exits each loop 38, it threads the pull cord 24 that is tied to it through each loop 38. When the drawstring 40 is drawn completely through each loop 38, the pull cord 24 is completely threaded through each loop 38. The pull cord 24 is then untied from the drawstring 40. Finally, the pull cord 24 is secured to the bottom rail.

Because the drawstring 40 is already threaded through each loop 38 before the assembly process begins, the labor-intensive step of hand threading each loop 38 according to the prior art method is eliminated. An assembly worker need not perform the cumbersome task of grasping the pull cord 24 with one hand while holding each loop 38 open with the other hand and threading the pull cord through each loop 38 one by one. Instead, the assembly worker merely ties the pull cord 24 to the drawstring 40, pulls the drawstring 40 to draw the pull cord 24 through each loop, and unties the pull cord 24 from the drawstring 40. The ladder 32 thus makes the assembly process much quicker and cheaper as compared to prior assembly processes involving old ladders.

SCOPE OF THE INVENTION

The above presents a description of the best mode contemplated for carrying out the present ladder for horizontal blinds, and of the manner and process of making and using it, in such full, clear, concise, and exact terms as to enable any person skilled in the art to which it pertains to make and use this ladder. This ladder is, however, susceptible to modifications and alternate constructions from that discussed above which are fully equivalent. Consequently, it is not the intention to limit this ladder to the particular embodiments disclosed. On the contrary, the intention is to cover all modifications and alternate constructions coming within the spirit and scope of the ladder as generally expressed by the following claims, which particularly point out and distinctly claim the subject matter of the ladder.

What is claimed is:

1. A method of assembling horizontal blinds, the method comprising the steps of:

providing a ladder having a first leg and a second leg, a plurality of rungs, each rung attached at a first end to the first leg and attached at a second end to the second leg, a plurality of loops attached to the first leg, and a first drawstring pre-threaded through the loops; and securing an upper or a lower end of the drawstring to an upper or a lower end of a pull cord.

2. The method of claim 1, further comprising the step of:

drawing the pull cord through each loop by pulling the upper or the lower end of the drawstring successively through each loop.

3. The method of claim 2, further comprising the step of:

threading the upper end of the pull cord through a headrail.

4. The method of claim 3, further comprising the step of:

securing the lower end of the pull cord to a bottom rail.

5. The method of claim 4, further comprising the step of:

securing the first and second legs at an uppermost end to a headrail, and at a lowermost end to the bottom rail.

6. The method of claim 5, further comprising the step of:

inserting a slat between each rung.

7. A method of assembling horizontal blinds, the method comprising the steps of:

providing a ladder having a first leg and a second leg, a plurality of rungs, each rung attached at a first end to the first leg and attached at a second end to the second leg, a plurality of loops attached to the first leg, a plurality of loops attached to the second leg, a first drawstring pre-threaded through the loops on the first leg, and a second drawstring pre-threaded through the loops on the second leg; and securing an upper or a lower end of the first drawstring to an upper or a lower end of a first pull cord.

8. The method of claim 7, further comprising the step of:

drawing the first pull cord through each loop on the first leg by pulling the upper or the lower end of the first drawstring successively through each loop.

9. The method of claim 8, further comprising the step of:

securing an upper or a lower end of the second drawstring to an upper or a lower end of a second pull cord.

10. The method of claim 9, further comprising the step of:

drawing the second pull cord through each loop on the second leg by pulling the upper or the lower end of the second drawstring successively through each loop.

11. A ladder for horizontal blinds, comprising:

a first leg and a second leg;

a plurality of rungs, each rung connected at a first end to the first leg, and connected at a second end to the second leg;

a plurality of loops connected to the first leg;

a disposable drawstring threaded through substantially all of the loops on the first leg; and a pull cord; wherein the drawstring is secured at a first end to a first end of the pull cord, and the pull cord is not initially threaded through any of the loops on the first leg.

12. A ladder for horizontal blinds, comprising:

a first leg and a second leg;

a plurality of rungs, each rung connected at a first end to the first leg, and connected at a second end to the second leg;

a plurality of loops connected to the first leg;

a disposable drawstring threaded through substantially all of the loops on the first leg; and a pull cord; wherein the drawstring is secured at a first end to a first end of the pull cord, and an overall length of the drawstring and the pull cord is greater than or equal to twice the length of the first leg.

* * * * *